US007617628B2

(12) United States Patent
Curry

(10) Patent No.: US 7,617,628 B2
(45) Date of Patent: Nov. 17, 2009

(54) FIRE CONTROL MECHANISM FOR A FIREARM

(75) Inventor: Brett Curry, Chicopee, MA (US)

(73) Assignee: Smith & Wesson Corp., Springfield, MA (US)

( * ) Notice: Subject to any disclaimer, the term of this patent is extended or adjusted under 35 U.S.C. 154(b) by 438 days.

(21) Appl. No.: 11/315,506

(22) Filed: Dec. 22, 2005

(65) Prior Publication Data

US 2006/0248772 A1 Nov. 9, 2006

Related U.S. Application Data

(60) Provisional application No. 60/639,187, filed on Dec. 22, 2004, provisional application No. 60/638,594, filed on Dec. 22, 2004, provisional application No. 60/638,753, filed on Dec. 22, 2004, provisional application No. 60/638,593, filed on Dec. 22, 2004, provisional application No. 60/638,746, filed on Dec. 22, 2004, provisional application No. 60/638,592, filed on Dec. 22, 2004, provisional application No. 60/638,751, filed on Dec. 22, 2004, provisional application No. 60/638,752, filed on Dec. 22, 2004.

(51) Int. Cl.
*F41A 17/36* (2006.01)

(52) U.S. Cl. ..... 42/70.02; 89/144; 89/149

(58) Field of Classification Search ..... 42/70.02, 42/69.01; 89/132, 144, 149
See application file for complete search history.

(56) References Cited

U.S. PATENT DOCUMENTS 1,455,880 A * 5/1923 Hammond ..... 89/145
2,053,489 A * 9/1936 Norman ..... 89/138
2,296,998 A * 9/1942 Koehler ..... 89/150
2,372,519 A * 3/1945 Roper ..... 89/137
3,103,758 A * 9/1963 Wilhelm ..... 42/69.02
4,011,678 A 3/1977 Brodbeck et al.
4,031,648 A 6/1977 Thomas
4,522,105 A 6/1985 Atchisson
4,539,889 A 9/1985 Glock
4,646,619 A * 3/1987 Sokolovsky ..... 89/145
4,825,744 A 5/1989 Glock
4,893,546 A 1/1990 Glock
4,967,724 A 11/1990 Senfter
5,012,604 A 5/1991 Rogers
5,018,292 A 5/1991 West
5,024,139 A 6/1991 Knight, Jr. et al.
5,036,612 A 8/1991 Jennings (Continued)

*Primary Examiner*—Stephen M Johnson
(74) *Attorney, Agent, or Firm*—McCormick, Paulding & Huber LLP

(57) ABSTRACT

A firearm includes a frame and a slide. A firing mechanism for the firearm includes a striker-type firing pin, a trigger, and a trigger bar. A sear inside the frame is pivotally balanced about a central fulcrum, and is biased in a first pivotal direction by a spring. In this position, a rear portion of the sear engages the firing pin. Actuation of the trigger causes the trigger bar to move rearwards for engagement of a forward portion of the sear. This pivots the sear in a second pivotal direction, against the spring, which releases the firing pin. The spring then causes the sear to pivot back for reengaging the firing pin when it returns to its rear position. Movement of the slide to a retired position causes the trigger bar to disengage from the sear (preventing discharge of the firearm) until the slide returns to a battery position.

20 Claims, 16 Drawing Sheets

U.S. PATENT DOCUMENTS 5,050,480 A 9/1991 Knight, Jr. et al.
5,050,481 A 9/1991 Knight, Jr. et al.
5,081,780 A 1/1992 Lishness et al.
5,086,578 A 2/1992 Lishness et al.
5,086,579 A 2/1992 Flatley et al.
5,088,222 A 2/1992 Larson
5,090,147 A 2/1992 Pastor
5,105,570 A 4/1992 Lishness et al.
5,115,588 A 5/1992 Bronsart et al.
5,119,634 A 6/1992 Berry et al.
5,149,898 A 9/1992 Chesnut et al.
5,157,209 A * 10/1992 Dunn ..... 42/70.08
5,160,796 A 11/1992 Tuma et al.
5,164,534 A 11/1992 Royster
5,166,458 A 11/1992 Yoo
5,187,312 A 2/1993 Osborne
5,195,226 A 3/1993 Bornancini
5,216,191 A 6/1993 Fox
5,216,195 A 6/1993 Turna
5,225,612 A 7/1993 Bernkrant
5,235,770 A 8/1993 Simon et al.
5,241,769 A 9/1993 Von Muller
5,247,757 A 9/1993 Deeb
5,251,394 A 10/1993 Bornancini
5,267,407 A 12/1993 Bornancini
5,272,957 A 12/1993 Chesnut et al.
5,299,374 A 4/1994 Mathys
5,303,494 A 4/1994 Turna et al.
5,327,810 A 7/1994 Sandusky et al.
5,349,939 A 9/1994 Perrone
5,355,768 A 10/1994 Felk
5,373,775 A 12/1994 Findlay, Sr. et al.
5,386,659 A * 2/1995 Vaid et al. ..... 42/69.02
5,388,362 A 2/1995 Melcher
5,400,537 A 3/1995 Meller et al.
5,412,894 A 5/1995 Moon
5,417,001 A 5/1995 Rousseau
5,426,881 A 6/1995 Ruger
5,438,784 A 8/1995 Lenkarski et al.
5,448,939 A 9/1995 Findlay, Sr. et al.
5,487,233 A 1/1996 Jewell
5,493,806 A 2/1996 Langevin et al.
5,502,914 A 4/1996 Moon
5,517,896 A 5/1996 Perrine
5,517,987 A 5/1996 Tsuchiya
5,548,914 A 8/1996 Anderson
5,570,527 A 11/1996 Felicci
5,581,927 A 12/1996 Meller
5,604,326 A 2/1997 Lescure
5,606,825 A 3/1997 Olsen
5,615,507 A 4/1997 French
5,623,114 A 4/1997 Soper
5,625,971 A 5/1997 Tuma et al.
5,634,456 A 6/1997 Perrone
5,635,664 A 6/1997 Pons et al.
5,640,794 A 6/1997 Gardner et al.
5,655,326 A 8/1997 Levavi et al.
5,669,169 A 9/1997 Schmitter et al.
5,680,722 A 10/1997 French et al.
5,697,178 A 12/1997 Haskell
5,701,698 A 12/1997 Wesp et al.
5,709,046 A 1/1998 Canaday
5,711,286 A 1/1998 Petrosyan et al.
5,713,150 A 2/1998 Ealovega
5,717,156 A 2/1998 Lenkarski
5,718,074 A 2/1998 Keeney
5,736,667 A 4/1998 Munostes et al.
5,760,328 A 6/1998 Robbins
5,770,814 A 6/1998 Ealovega
5,778,585 A 7/1998 Sigg
5,797,206 A 8/1998 Vitorino
5,806,225 A 9/1998 Gardner et al.
5,815,973 A 10/1998 Hochstrate
5,826,362 A 10/1998 Lyons
5,834,678 A 11/1998 Kalb
5,852,891 A 12/1998 Onishi et al.
5,857,280 A 1/1999 Jewell
5,906,066 A 5/1999 Felk
5,913,261 A 6/1999 Guhring et al.
5,974,717 A 11/1999 Brooks
5,987,796 A 11/1999 Brooks
6,000,162 A 12/1999 Hochstrate
6,070,512 A 6/2000 Rohrbaugh
6,125,735 A 10/2000 Guhring
6,131,324 A 10/2000 Jewell
6,134,852 A 10/2000 Shipman et al.
6,164,001 A 12/2000 Lee
6,205,694 B1 3/2001 Davis, Sr.
6,240,669 B1 6/2001 Spaniel et al.
6,253,479 B1 7/2001 Fuchs et al.
6,256,918 B1 7/2001 Szabo
6,256,920 B1 7/2001 Olson
6,263,607 B1 7/2001 Fuchs et al.
6,266,909 B1 7/2001 Fuchs et al.
6,272,683 B1 8/2001 Symms et al.
6,272,783 B1 8/2001 Dumortier et al.
6,289,619 B1 9/2001 Fuchs et al.
6,293,039 B1 9/2001 Fuchs
6,341,442 B1 1/2002 Szabo et al.
6,354,032 B1 3/2002 Viani
6,367,186 B1 4/2002 Gibala
6,381,892 B1 5/2002 Szabo et al.
6,382,200 B1 5/2002 Levkov
6,405,631 B1 6/2002 Milek
6,412,206 B1 7/2002 Strayer
6,415,702 B1 7/2002 Szabo et al.
6,425,199 B1 7/2002 Vaid et al.
6,448,939 B2 9/2002 Maruta
6,513,273 B2 2/2003 da Silveira
6,519,887 B1 2/2003 Allen et al.
6,526,684 B1 3/2003 Hickerson
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 5/2003 Cominolli
6,588,136 B2 7/2003 Baker et al.
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,665,973 B1 12/2003 Peev
6,688,210 B2 2/2004 Bubits
6,705,036 B2 3/2004 Orr
6,711,824 B2 3/2004 Hruska
6,711,842 B1 3/2004 Chapman
6,718,680 B2 4/2004 Roca et al.
6,732,464 B2 5/2004 Kurvinen
6,735,897 B1 5/2004 Schmitter et al.
6,769,208 B2 8/2004 Beretta
6,789,342 B2 9/2004 Wonisch et al.

* cited by examiner

FIRE CONTROL MECHANISM FOR A FIREARM

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592; Ser. No. 60/638,751; and Ser. No. 60/638,752, all filed Dec. 22, 2004, and all hereby incorporated by reference herein in their entireties.

FIELD OF THE INVENTION

The present invention relates to semiautomatic pistols or handguns and, more particularly, to fire control mechanisms for semiautomatic pistols or handguns.

BACKGROUND OF THE INVENTION

One type of fire control mechanism commonly used in semiautomatic handguns includes a hammer that is pivotable from a rearward cocked position to a forward position for impacting a firing pin. A sear releasably retains the hammer in the cocked position via a spring maintained in compression. When the trigger is moved, the sear is moved to release the hammer, which moves in response to the release of the stored energy in the spring, thereby allowing the hammer to strike the firing pin which in turn is driven forward to fire a chambered cartridge.

Another common fire control mechanism utilizes a striker-type firing pin. In handguns employing the striker-type firing pin, the trigger is connected to a trigger bar. Movement of the trigger causes movement of the trigger bar, which in turn (in certain embodiments) causes a sear to rotate about a pivot point. Upon rotation of the sear, a spring is compressed and an upper portion of the sear is displaced relative to the firing pin. Upon displacing the sear a sufficient distance to clear a depending leg of the firing pin, the firing pin is urged forward by a spring and strikes the rear of the cartridge, thereby discharging the firearm.

In either configuration (the pivotable hammer or the striker-type), the sear is an elongated element that is rotatable about a pivot point located substantially at one end thereof. By locating the pivot point at one end, the elongated element can be fairly easily rotated about the pivot point. In particular, because a substantial portion of the mass of the elongated element is located at one point distal from the pivot point, there is a tendency for the elongated element to rotate about the pivot point.

SUMMARY OF THE INVENTION

An embodiment of the present invention relates to a firearm having a frame, a slide, a trigger, a trigger bar, and a striker-type firing pin. The firearm further includes a rocker-like sear pivotally connected to the frame. A forward portion of the sear is configured for engagement with the trigger bar, and a rearward portion of the sear is configured for engagement with the firing pin. A sear biasing member such as a spring biases the sear in a first pivotal direction for engaging the firing pin. Rearwards movement of the trigger bar causes the trigger bar to engage the forward sear portion and pivot the sear in a second pivotal direction, against the action of the sear biasing member, until the rearward sear portion disengages from the firing pin. The firing pin thereafter moves forward for discharge of the firearm.

In another embodiment, in moving rearwards after discharge, the slide causes the trigger bar to temporarily laterally disengage from the sear. This allows the sear to pivot back in the first pivotal direction to catch the firing pin upon its rearward return. Subsequently, the slide returns to a forward position, allowing the trigger bar to reengage the sear, but typically only after the trigger is released and the trigger bar has returned to its forward position.

In another embodiment, the present invention provides a sear in which the mass of the sear is more evenly distributed on opposite sides of the pivot point. One advantage of a handgun having this type of fire control mechanism is that the sear is rendered more likely to remain stationary. In particular, a more positive force is required to cause the sear to rotate or move about its center of mass.

Additionally, an embodiment of the present invention provides a mechanism that inhibits movement of the sear when a magazine is not inserted into the handgun. With this mechanism, the handgun is rendered inoperative without a magazine in the magazine well. Even if a cartridge is ramped into the chamber, movement of the trigger should not discharge the firearm as long as the magazine is not inserted or is subsequently removed. Thus, the handgun and the magazine can be stored separately or readily separated to inhibit unauthorized use.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
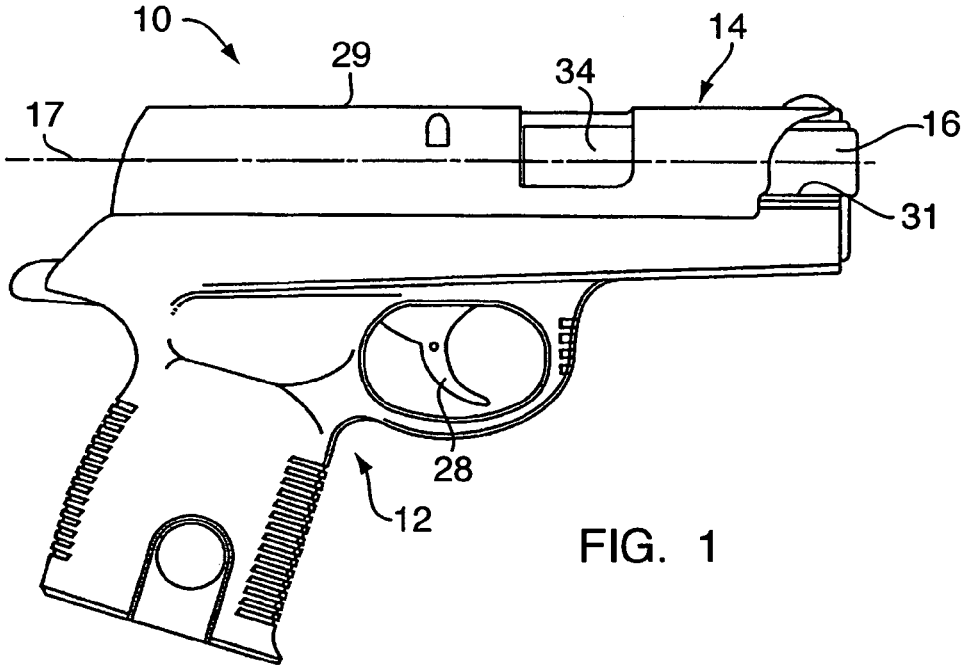
FIGS. 1 and 2 are simplified schematic views of a semiautomatic handgun showing the slide thereof in battery and retired positions, respectively.
Figure 2:
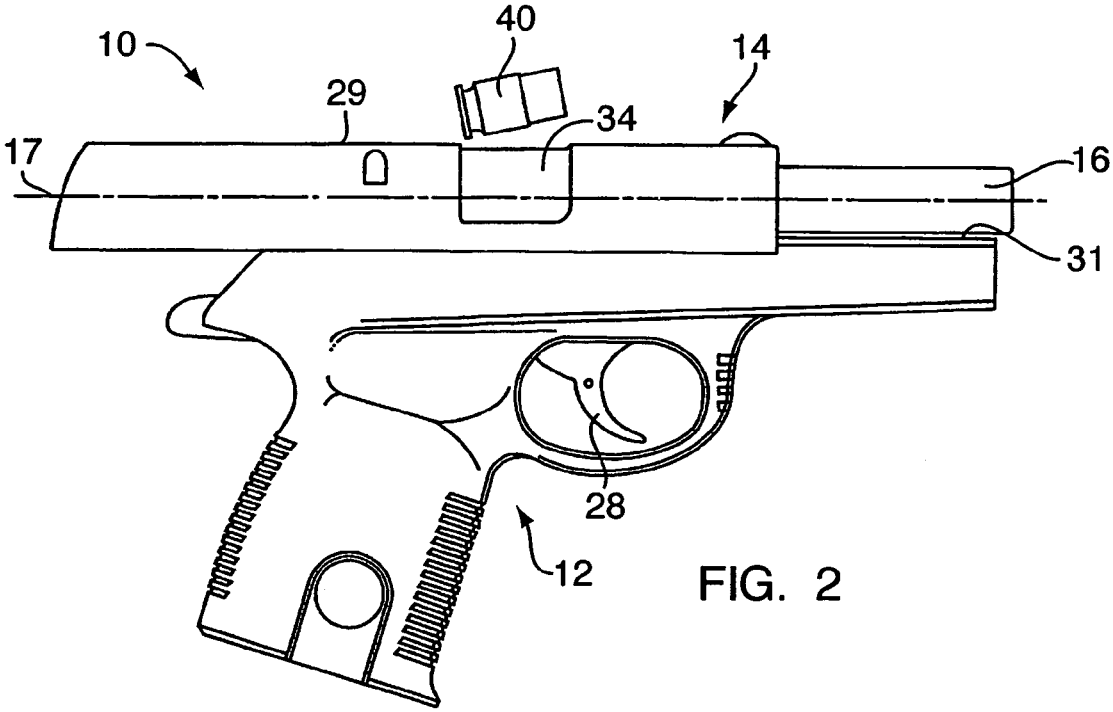

Referring to FIGS. 1 and 2, a semiautomatic pistol or handgun is shown generally at 10 and is hereinafter referred to as "handgun" 10. The handgun 10 comprises a frame 12, a slide 14, a barrel 16, and a fire control mechanism 18 (see FIG. 3). The barrel 16 is disposed at the front aperture of the slide 14 and is cooperatively linked therewith, and, together with the slide 14, defines a longitudinal firing axis 17. The barrel 16 has a rearward end adapted for receiving an ammunition cartridge 40. A trigger 28 is pivotally mounted to the frame 12 to actuate the fire control mechanism to fire the handgun 10. The frame 12 is fabricated of a high-impact polymer material, metal, a combination of polymer and metal, or the like. The fire control mechanism or means 18 is provided for discharging a round of ammunition upon actuation of the trigger 28.

The slide 14 is fitted to opposingly-positioned rails 31 of the frame 12 to effect the reciprocal movement of the slide 14 along the longitudinal firing axis 17. The rails 31 extend along the underside of the slide 14 in the longitudinal direction and are cooperative with the frame 12 to allow the cycling of the slide 14 between forward (battery) and rearward (retired) positions. The slide 14, which is defined by a slide frame 29, further includes a firing chamber, an ejection port 34, and an ejection mechanism that provides for the ejection of the cartridge 40 through the ejection port 34 upon firing the handgun 10 or upon manual cycling of the slide 14.

The cooperation of the frame 12, the slide 14, the barrel 16, and the firing mechanism during the loading, firing, and ejecting of a cartridge 40 or a cartridge casing can be understood by referring to U.S. Pat. No. 5,086,579 entitled "DECOCKING MECHANISM FOR A SEMI-AUTOMATIC FIREARM"; U.S. Pat. No. 5,386,659 entitled "FIRE CONTROL MECHANISM FOR SEMIAUTOMATIC PISTOLS"; and U.S. Pat. No. 5,406,731 entitled "HANDGUN OF IMPROVED ERGONOMIC CONSTRUCTION," all of which are owned by the assignee of the present invention and are incorporated by reference herein.

Figure 3:
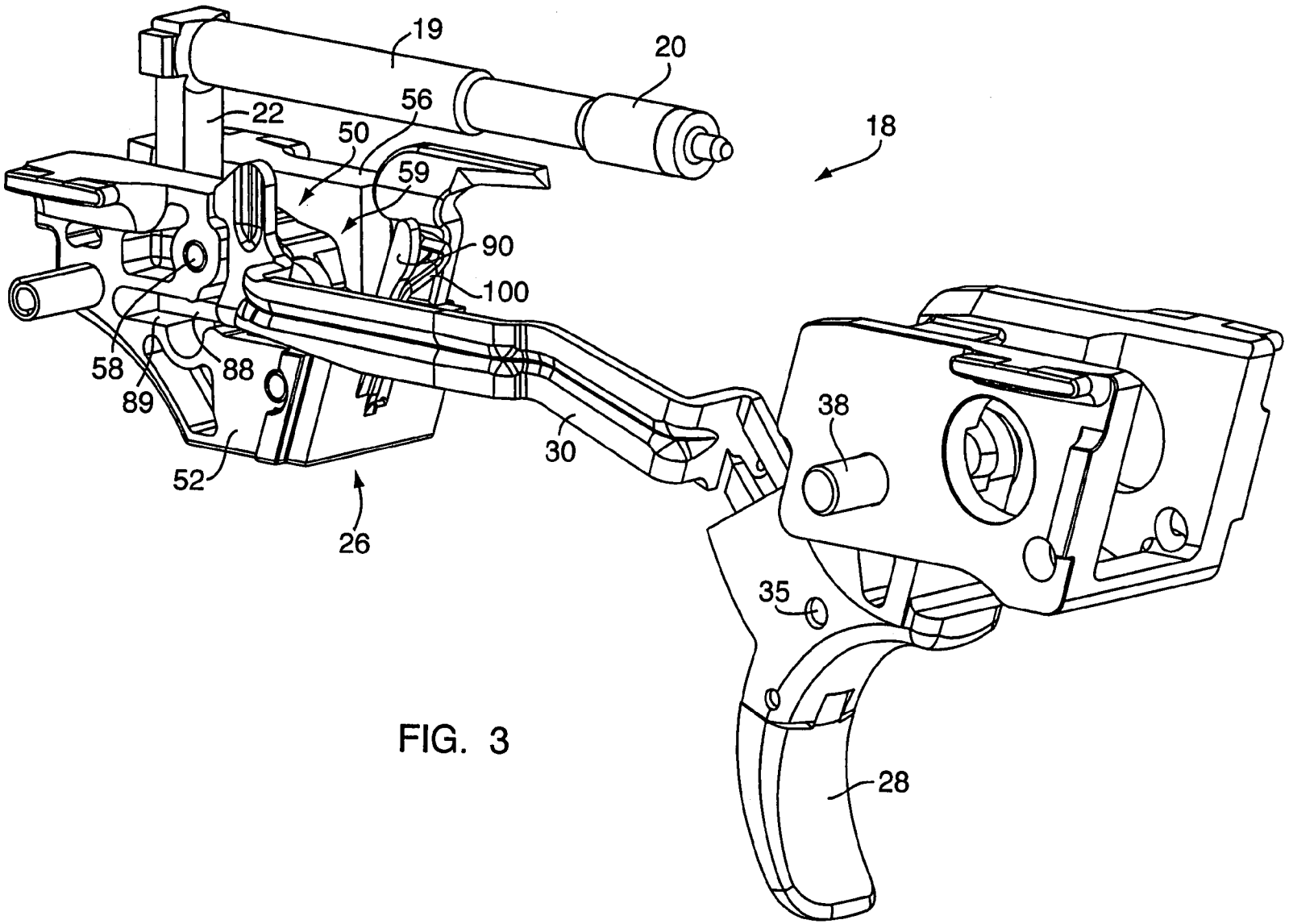
FIG. 3 is a simplified schematic perspective view of a fire control mechanism according to an embodiment of the present invention.

Referring now to FIG. 3, the fire control mechanism 18 includes a striker-type firing pin 19 having a forward firing pin portion 20 and a depending leg 22 extending down from the firing pin portion 20. The fire control mechanism 18 also includes a sear assembly 26 that is engagable by the firing pin 19. The sear assembly 26 is operably engagable with a trigger assembly that includes the trigger 28. Upon operation of the handgun (via movement of the trigger 28), a surface of the depending leg 22 selectively engages the sear assembly 26.

The trigger 28 may be of unitary construction, as shown, or of a multiple-piece articulated construction. The trigger 28 is pivotally connected to a trigger bar 30 via a pin 35. The trigger bar 30 may be biased in lateral directions via a spring or the like. Rearward movement of the trigger 28 causes movement of the trigger bar 30 in a rearward longitudinal direction. When the trigger 28 is actuated by being pressed in a rearward direction, the trigger 28 pivots about a pin 38, thereby transmitting rearward longitudinal movement to the trigger bar 30 via the pin 35. Longitudinal movement of the trigger bar 30 in a rearward direction, in turn, actuates the sear assembly 26, e.g., it unblocks the sear assembly, thereby allowing the firing pin 19 to translate in a forward direction under the action of a decompressing firing pin spring for the firing pin portion 20 to engage a cartridge and fire the handgun.

Figure 4:
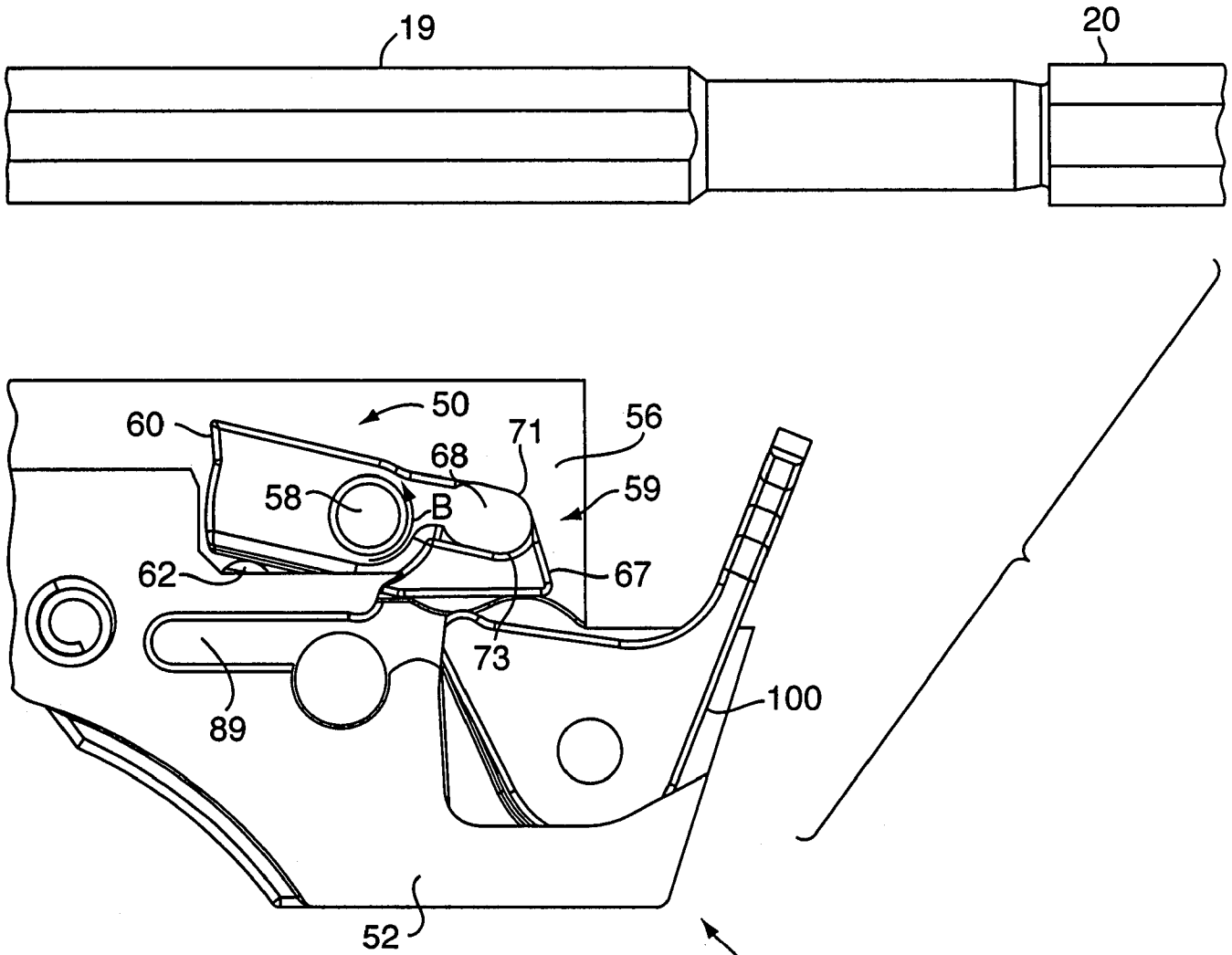
FIG. 4 is a simplified schematic elevational view of a sear of the fire control mechanism of the present invention.

Referring now to FIG. 4, the sear assembly 26 of the present invention comprises a sear or sear means 50 for controllably releasing the firing pin upon actuation of the trigger bar, a sear block housing 52, a sear spring or other biasing member 62, and a frame 56. (The frame 56 and housing 52 may be integral, and/or provided as part of the firearm frame 12.) The sear 50 is operably mounted in the sear block housing 52 between walls of the frame 56 so as to be pivotal about a fulcrum 58, which is located substantially at the center of mass of the sear 50. (By "substantially," it is meant that the mass of the sear on each side of the fulcrum 58 varies no more than 20% from a perfect balance, e.g., each side may have a mass S1, S2 of 0.5S±0.2S, where "S" is the mass of the sear and S1+S2=S. This provides a good balance for functionality according to the present invention, while still allowing for manufacturing variances or the like.) A forward portion 59 of the sear 50 directly forward of the fulcrum 58 is configured to inter-engage the trigger bar 30 and, optionally, a magazine detection lever 90 (discussed below). A rearward surface 60 of a rearward portion of the sear 50 directly behind the fulcrum 58 is configured to inter-engage the leg of the firing pin. The sear spring 62 is positioned underneath a bottom surface of the rearward portion of the sear 50 to urge the rearward portion upward such that the rearward surface 60 is engagable with the leg 22 of the firing pin 19.

Figure 5:
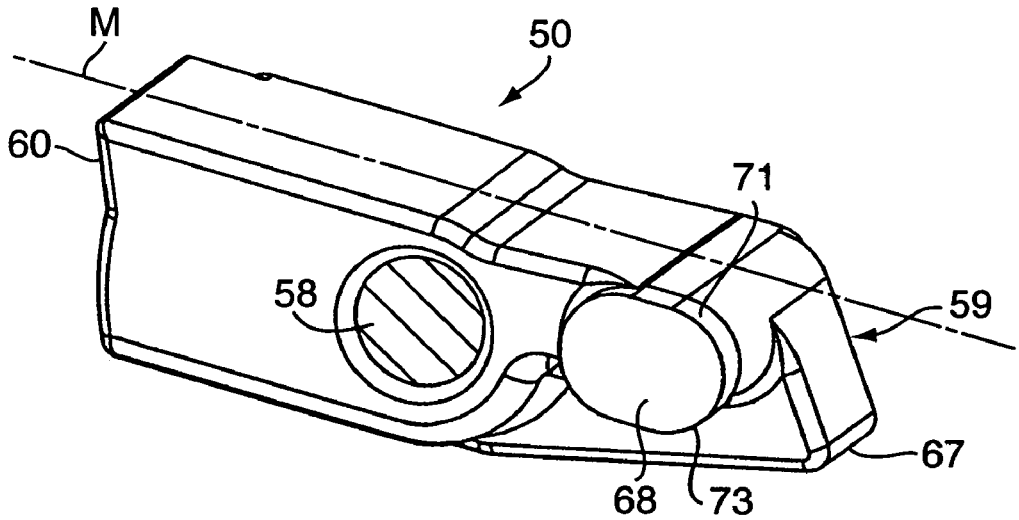
FIG. 5 is a simplified schematic perspective view of the sear of FIG. 4.

Referring now to FIG. 5, the sear 50 is an elongated member having a major axis M. The elongated member is pivotable about the fulcrum 58, which extends through the member in a direction that is substantially perpendicular (e.g., perpendicular within ±5 degrees) to the direction in which the major axis M extends. The forward portion 59 of the sear 50 is configured to have both a ramp portion 67 and a cam portion 68. From a side elevation, the cam portion 68 may have a cross-sectional configuration having an upper rounded surface 71 and a lower rounded surface 73, both of which extend perpendicular to the direction in which the major axis M extends and parallel to the direction in which the pivot axis defined by the fulcrum 58 extends. The ramp portion 67 extends downward from the lower rounded surface 73. A downward-facing surface of the ramp portion 67 is substantially flat. Both the forward portion 59 and the rearward portion are dimensioned and configured to have substantially the same masses relative to the fulcrum 58. Thus, the sear 50 is substantially balanced front-to-back.

Figure 6:
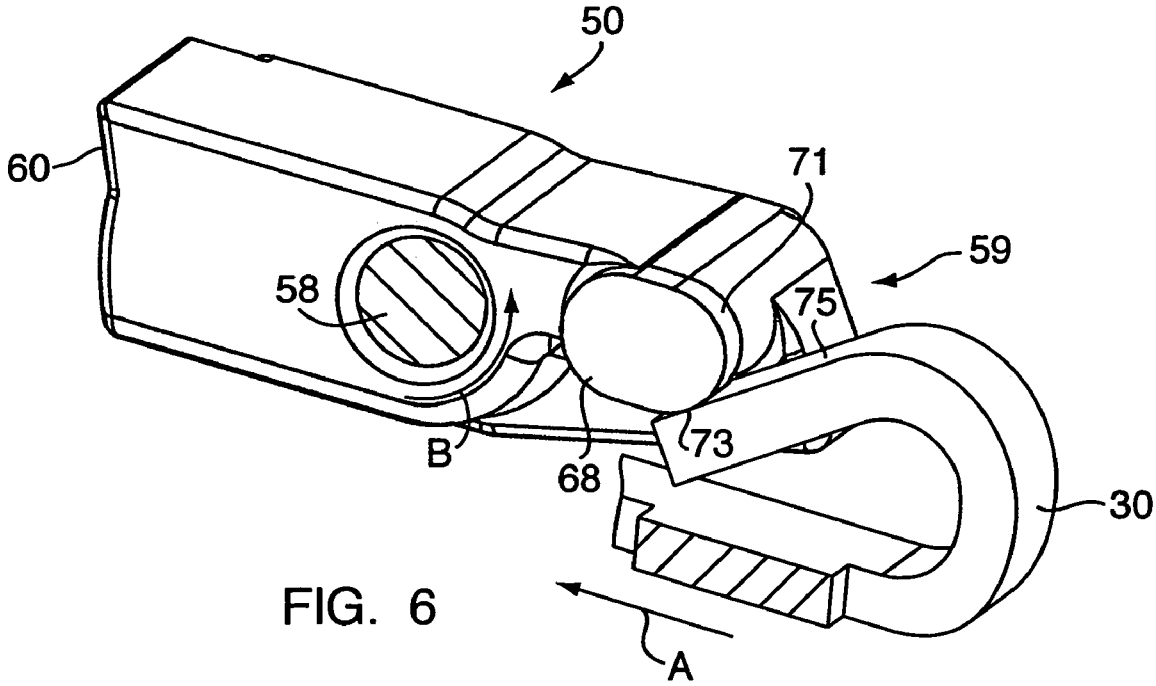
FIG. 6 is a simplified schematic perspective view of the engagement of the sear and a trigger bar of the fire control mechanism.

Referring now to FIG. 6, the dimensions and configuration of the sear 50 are such that the lower rounded surface 73 on the cam portion 68 acts cooperatively with the trigger bar 30. In particular, the lower rounded surface 73 engages a corresponding sloped surface 75 on the trigger bar 30 such that as the trigger is pulled, the trigger bar 30 moves rearward in the direction of an arrow A and in a plane that is at least partially coplanar with a plane in which the sear 50 rotates. In doing so, the sloped surface 75 on the trigger bar 30 engages the lower rounded surface 73 of the cam portion 68, the sear 50 is rotated in the direction of an arrow B, and the forward end of the sear 50 is urged upward, thereby causing the rearward surface 60 to move downward about the fulcrum 58. At a pre-selected distance, the sear 50 is pivoted fully downward against the sear spring to allow the leg 22 of the firing pin 19 to disengage from the rearward surface 60.

Figure 7A:
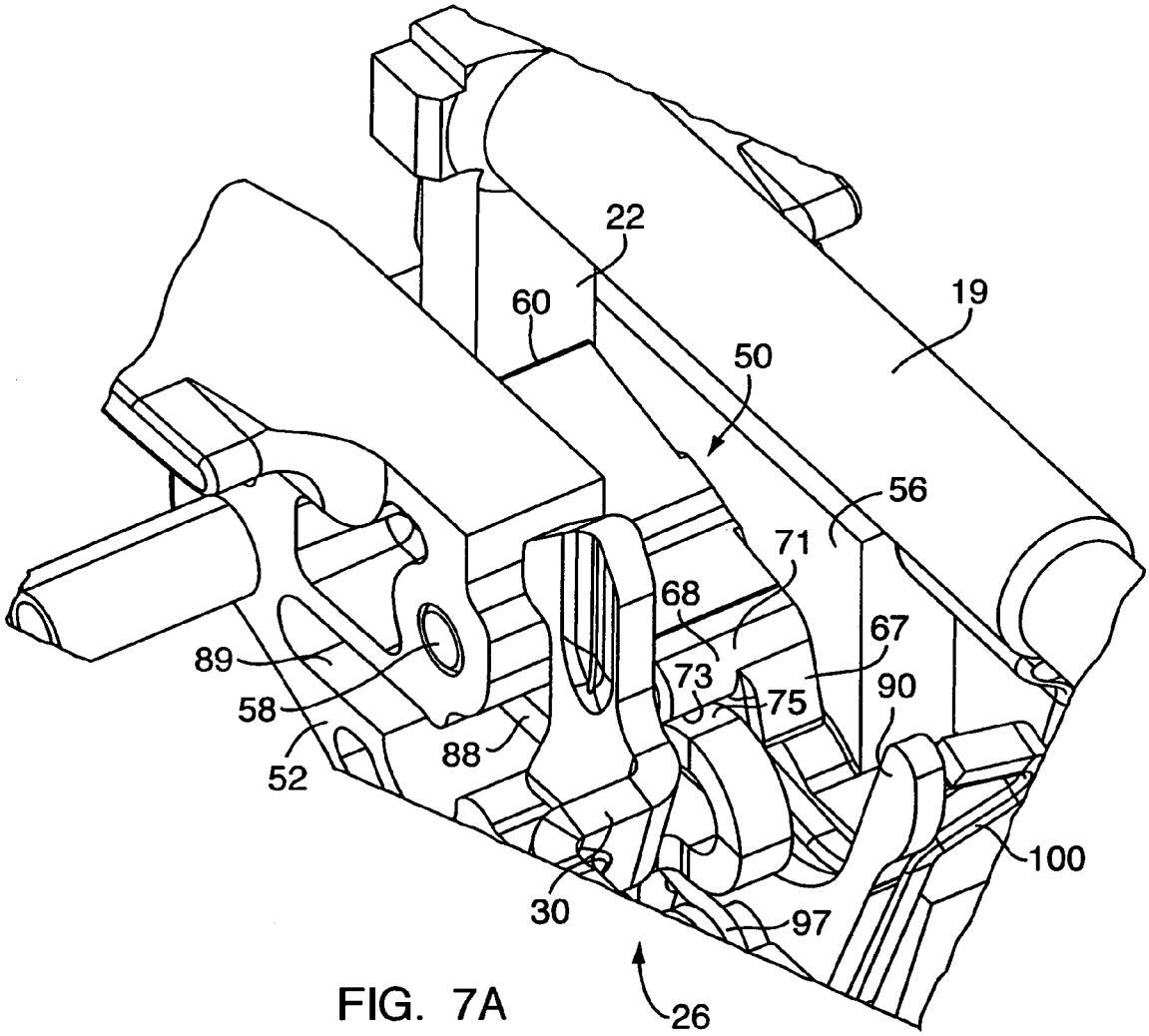
FIGS. 7A through 7C are simplified schematic views of the fire control mechanism of the present invention showing a sequential firing operation.
Figure 7B:
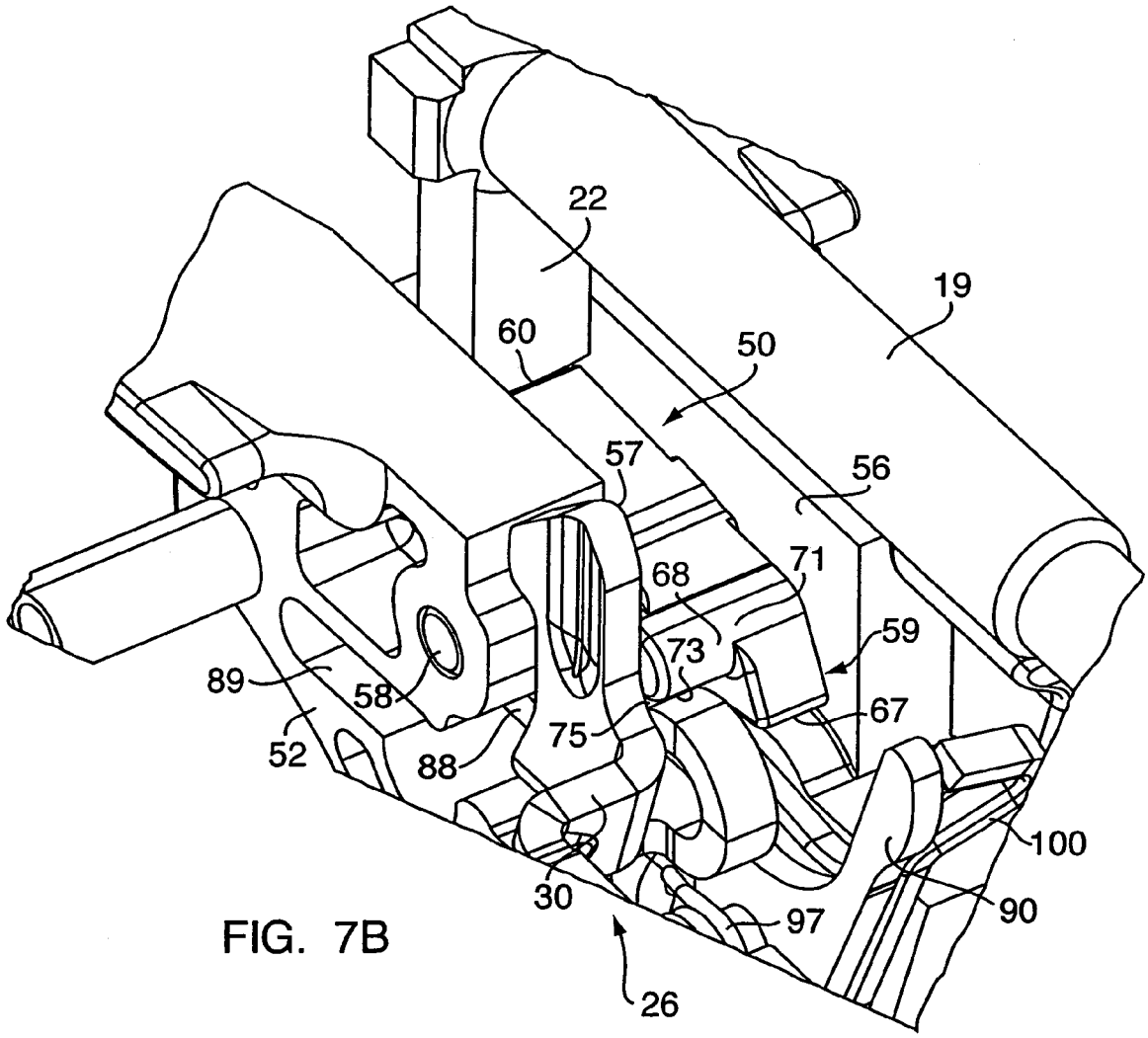
Figure 7C:
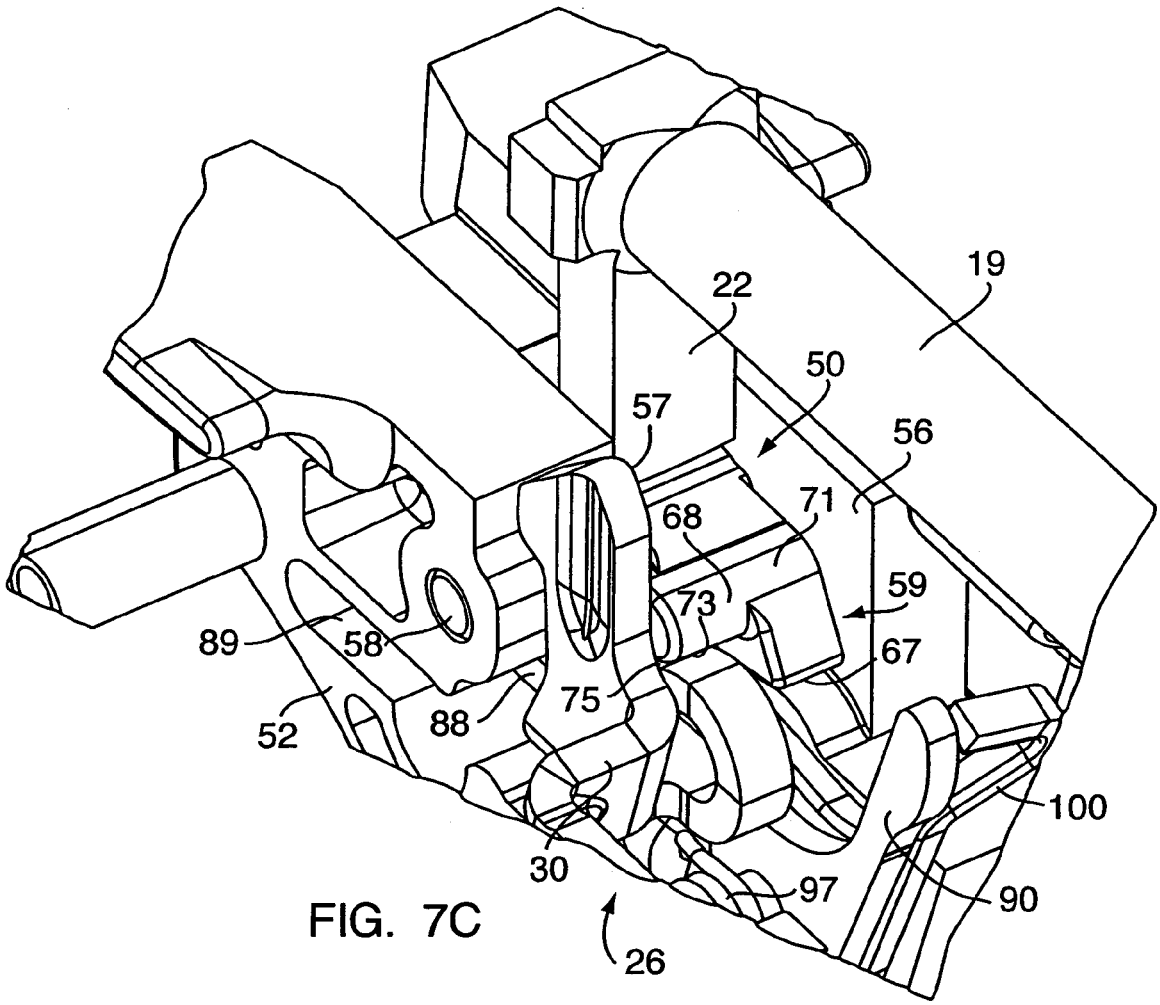

Referring now to FIGS. 7A through 7E, the operation of the handgun is illustrated. In FIG. 7A, the depending leg 22 of the firing pin 19 is engaged by the sear 50. As the trigger is pulled in the rearward direction (FIG. 7B), the trigger bar 30 likewise moves rearward, and the sloped surface 75 on the trigger bar 30 engages the lower rounded surface 73 of the sear 50 to urge the front of the sear 50 up and the rearward surface down (the sear 50 is pivoted about the fulcrum 58). The firing pin 19 is released and travels forward. The trigger bar 30 is fully extended in the rearward direction. Referring now to FIG. 7C (the trigger bar 30 is still fully rearward), the firing pin 19 continues to move in the forward direction for the firing pin portion 20 to discharge a cartridge. After discharging the cartridge, the slide moves rearward into the retired position.

Figure 7D:
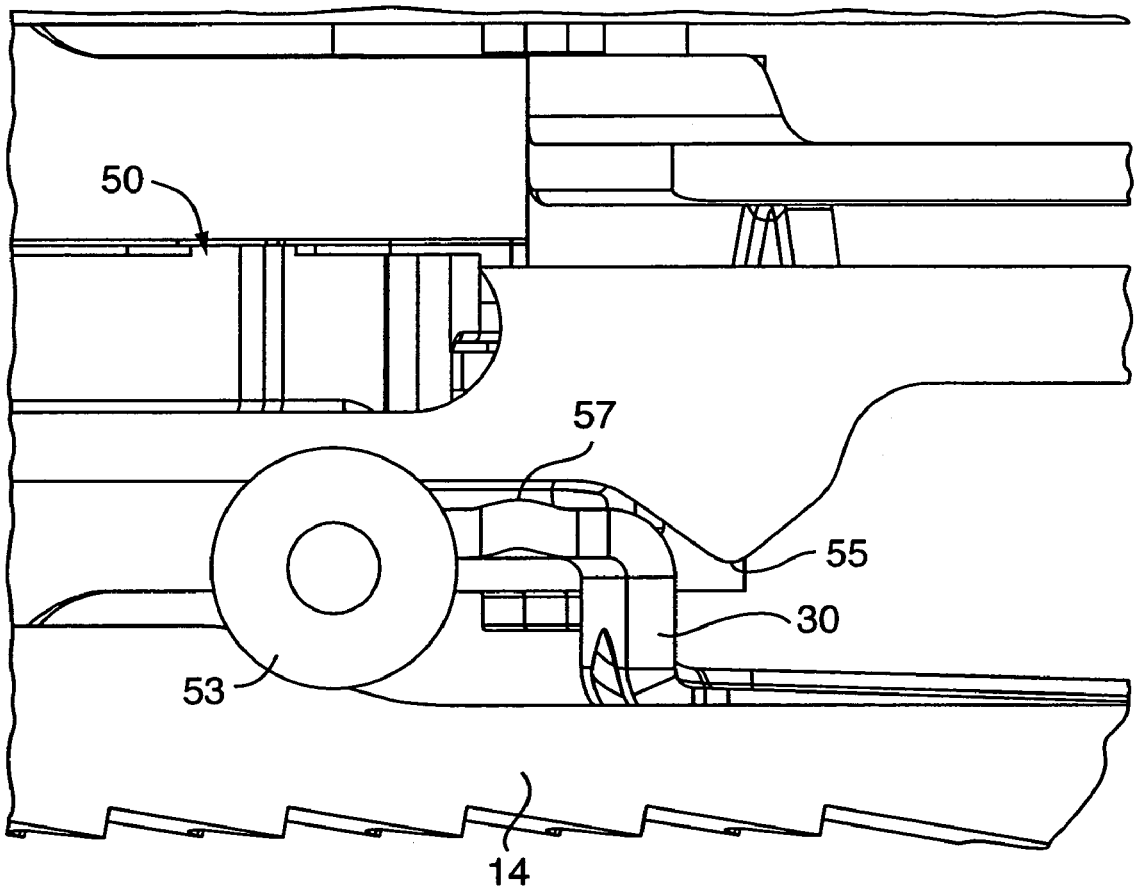
FIG. 7D is a simplified schematic view of the fire control mechanism in which the trigger bar is urged away from the sear.
Figure 7E:
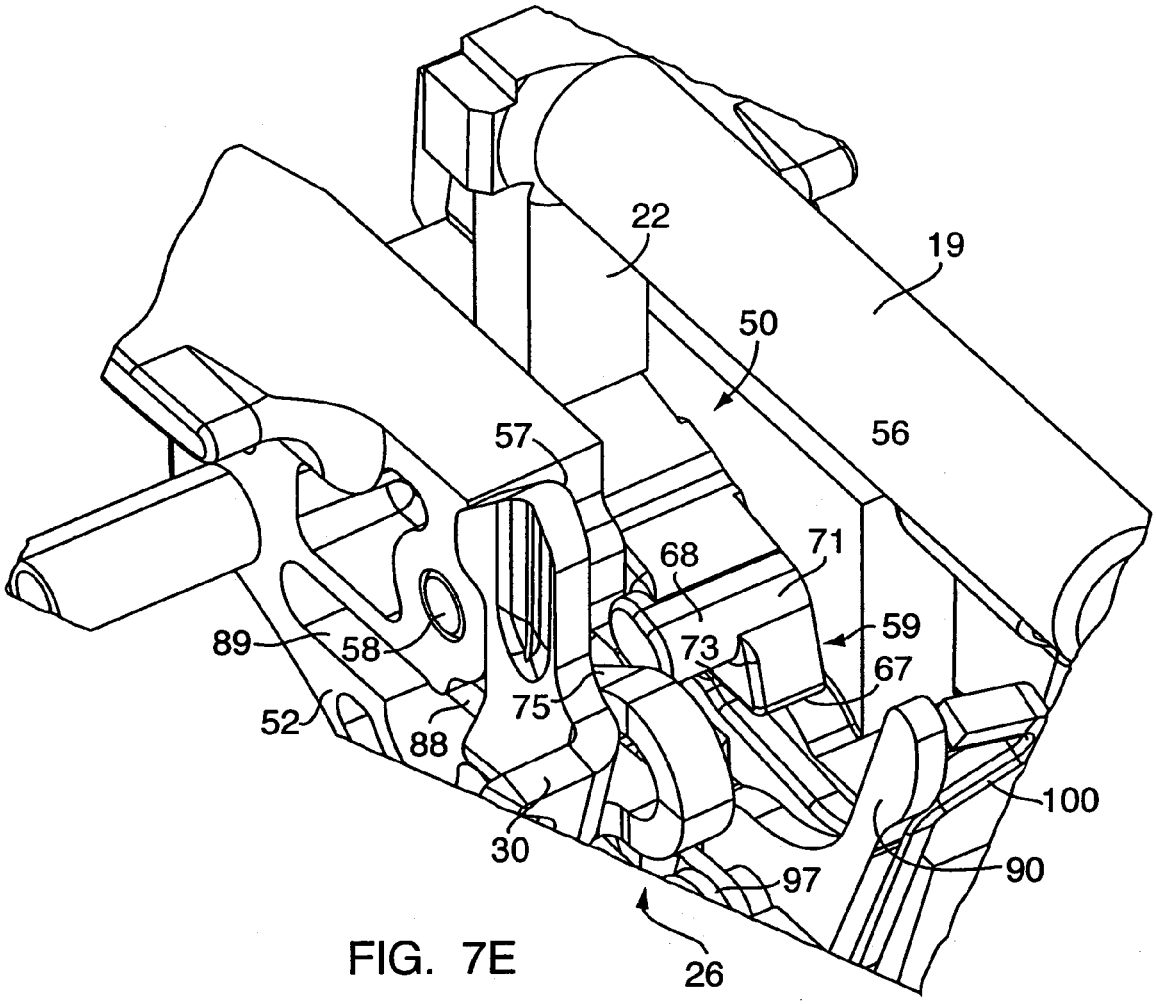
FIG. 7E is a simplified schematic plan view of the fire control mechanism in which a camming surface on the slide is shown in preparation for engaging the trigger bar during rearward movement of the slide.

Referring now to FIGS. 7D and 7E, the slide 14 and the firing pin 19 are shown in retreat. In FIG. 7D, as the slide moves rearward past a spring-biased firing pin safety 53, a camming surface 55 integrally formed with an undersurface of the slide 14 engages a receiving surface 57 on the trigger bar 30. The receiving surface 57 is defined by a radius or arcuate surface that, when engaged by the camming surface 55 of the retreating slide 14, urges the trigger bar 30 laterally away from the sear 50. As can be seen in FIG. 7E, upon retreat of the slide, the firing pin 19 is pulled back across the upper surface of the sear 50.

Figure 7F:
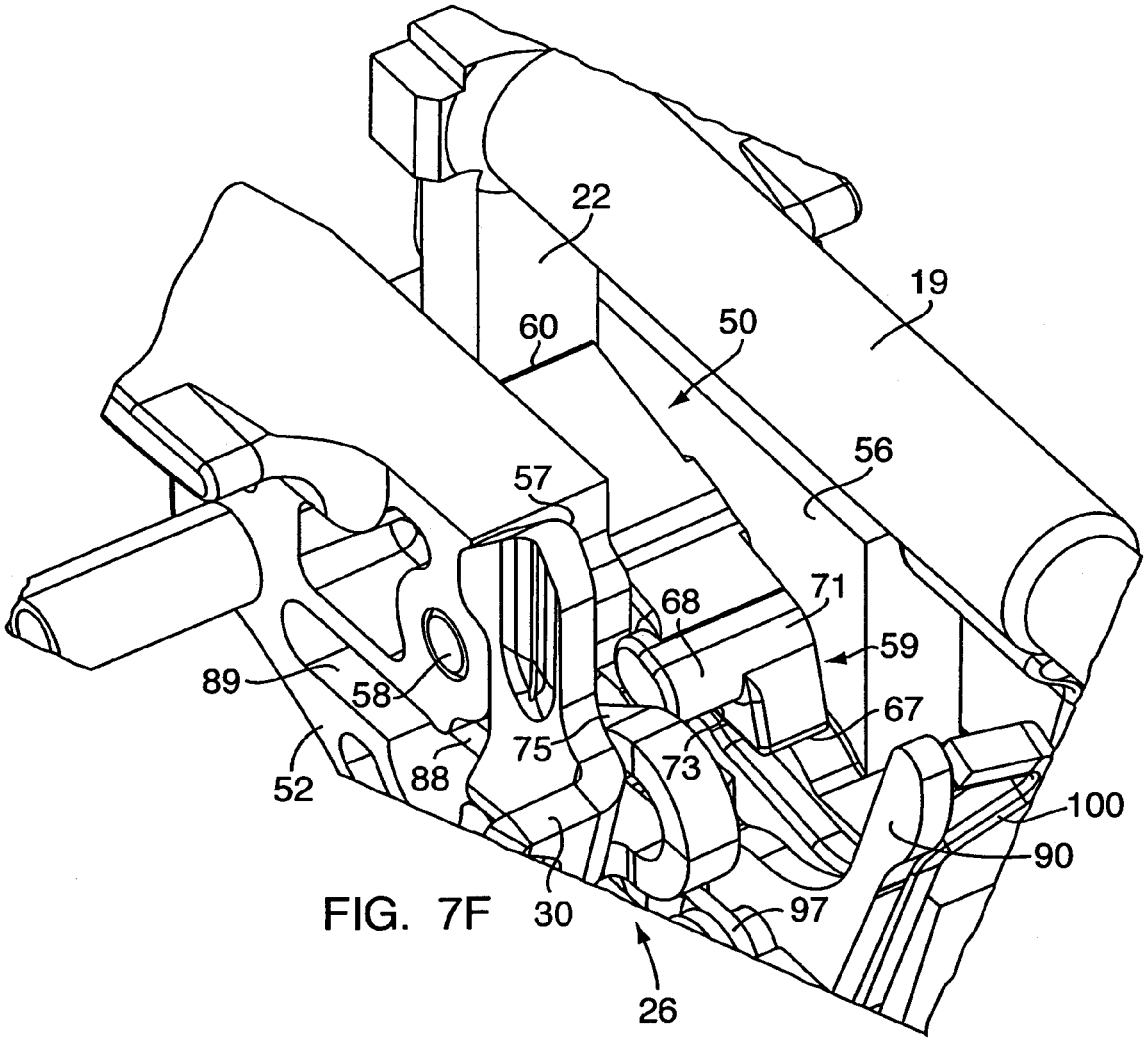
FIG. 7F is a simplified schematic view of the fire control mechanism in which the trigger bar is fully displaced by the camming surface on the slide during movement of the slide.

Referring to FIG. 7F, with the camming surface 55 still engaged with the receiving surface 57 to bias the trigger bar 30 laterally out of registration with the sear 50, the depending leg 22 of the firing pin 19 engages the rearward surface 60 of the sear 50, thus cocking the handgun. However, the handgun is not operational via the trigger because the trigger bar 30 is not engaged with the sear 50. As the slide is fully seated in the battery position, the camming surface 55 moves forward out of registration with the receiving surface 57, thus allowing the trigger bar 30 to return to its operational position in engagement with the sear 50. Typically, this will not happen until the trigger 28 is released and the trigger bar 30 is allowed to move forward (e.g., by way of a standard trigger return spring or the like, not shown). In other words, if the trigger remains depressed, the trigger bar 30 will remain disengaged from the sear even after the slide has returned to its forward position.

A spring may be provided (not shown) for biasing the trigger bar 30 laterally towards the sear 50, for helping the trigger bar 30 to return to its operational position in engagement with the sear 50 after the slide returns to the battery position. Also, as best shown in FIG. 3, the trigger bar 30 may be provided with an extension 88 cooperative with a track or channel 89 in the sear block housing 52, for purposes of laterally guiding the trigger bar 30 during displacement by the slide, and/or otherwise generally aligning the trigger bar 30 with the sear assembly 26. As should be appreciated, the connection of the trigger 28, trigger bar 30, and the sear assembly 26 is such that the trigger bar 30 can be laterally displaced when pressure is exerted on the trigger bar extension 88 in a direction that is perpendicular to the direction in which the longitudinal firing axis extends.

Figure 8:
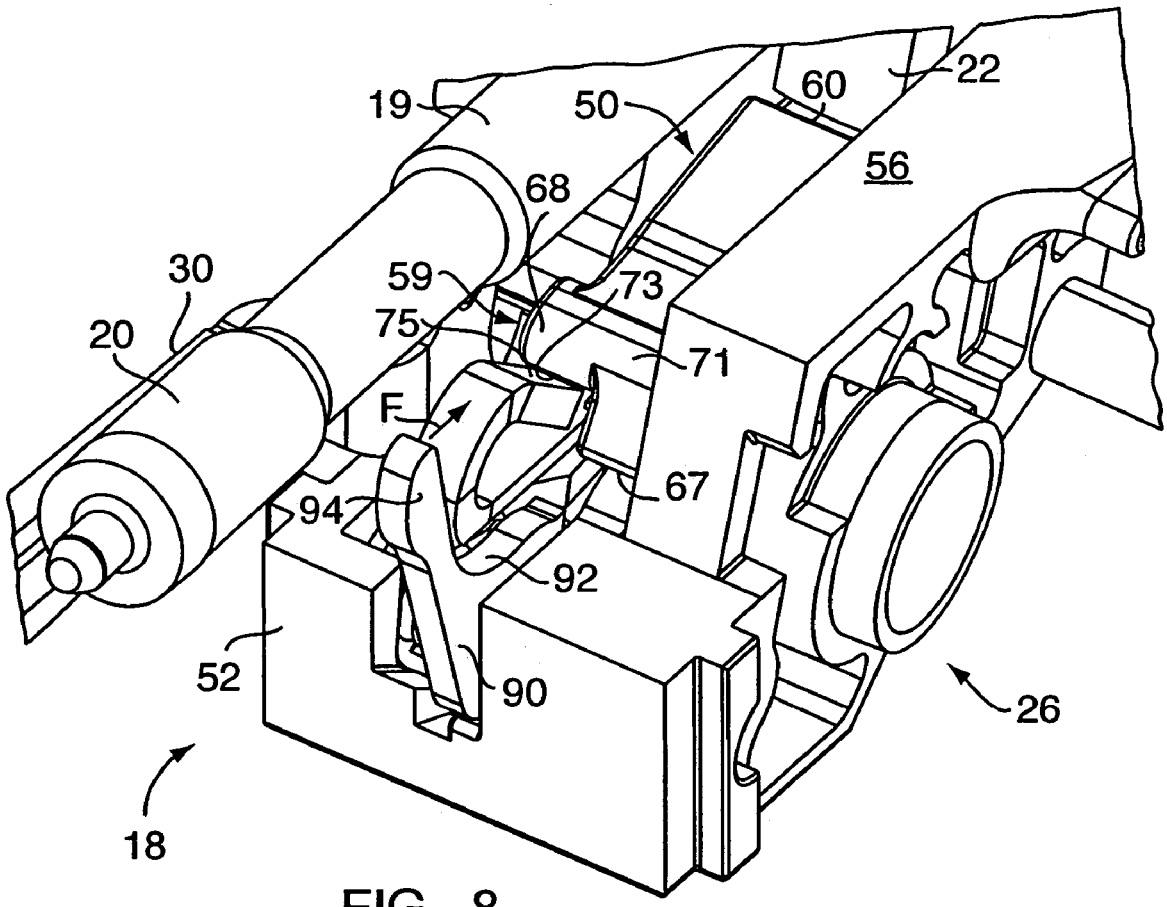
FIGS. 8 and 9 are simplified schematic views of a magazine detection lever of the fire control mechanism.
Figure 9:
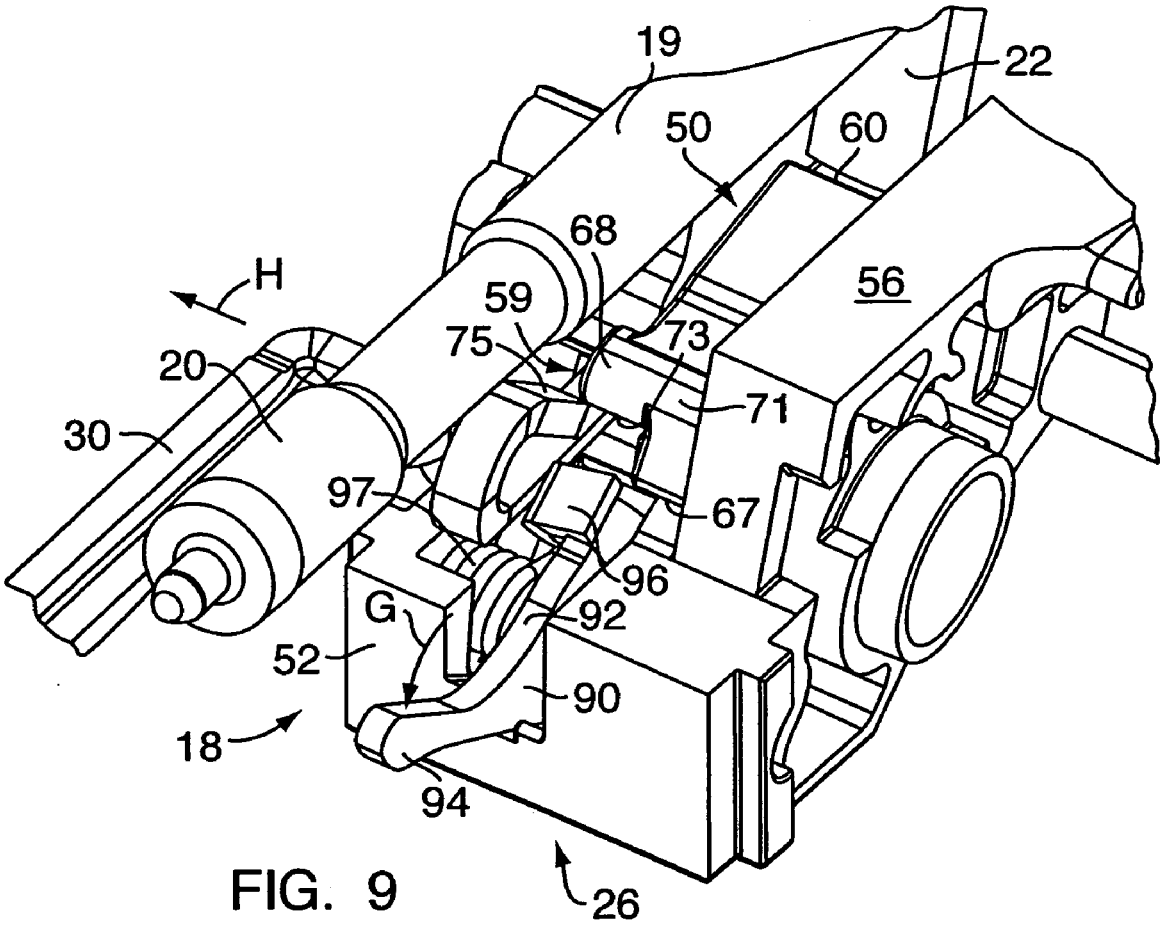
Figure 10:
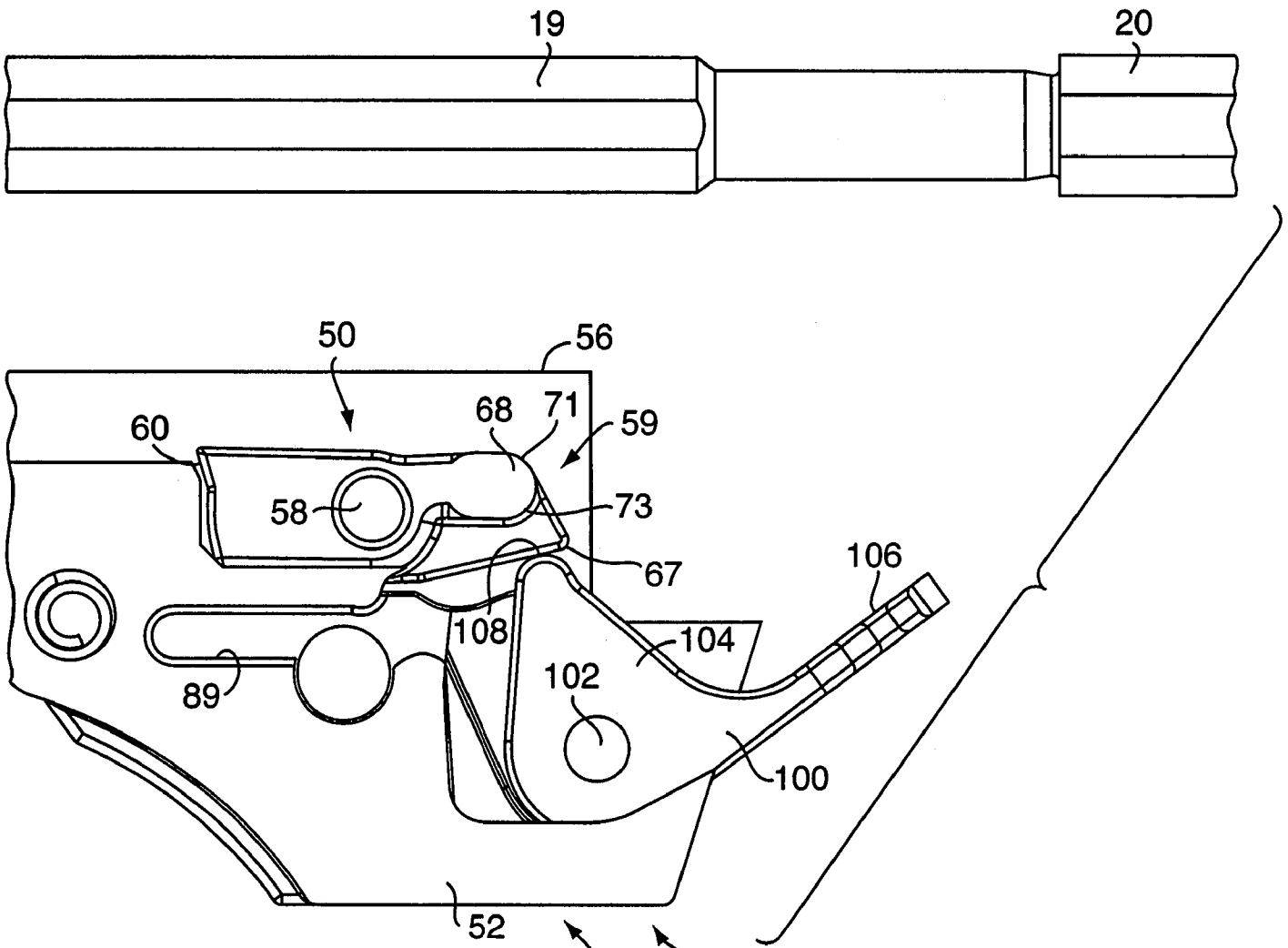
FIGS. 10 through 13 are simplified schematic views of a sear deactivation lever of the present invention.
Figure 11:
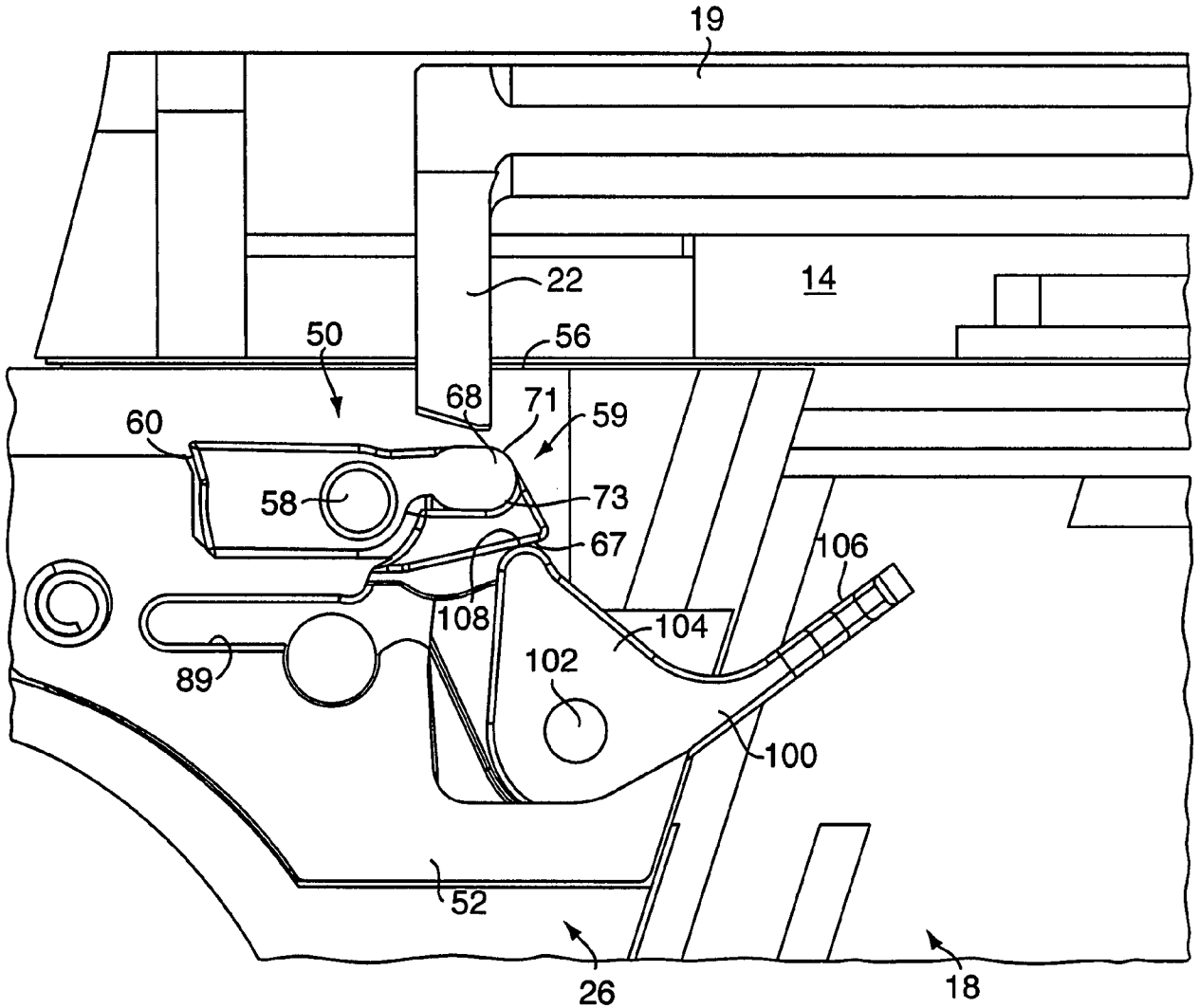
Figure 12:
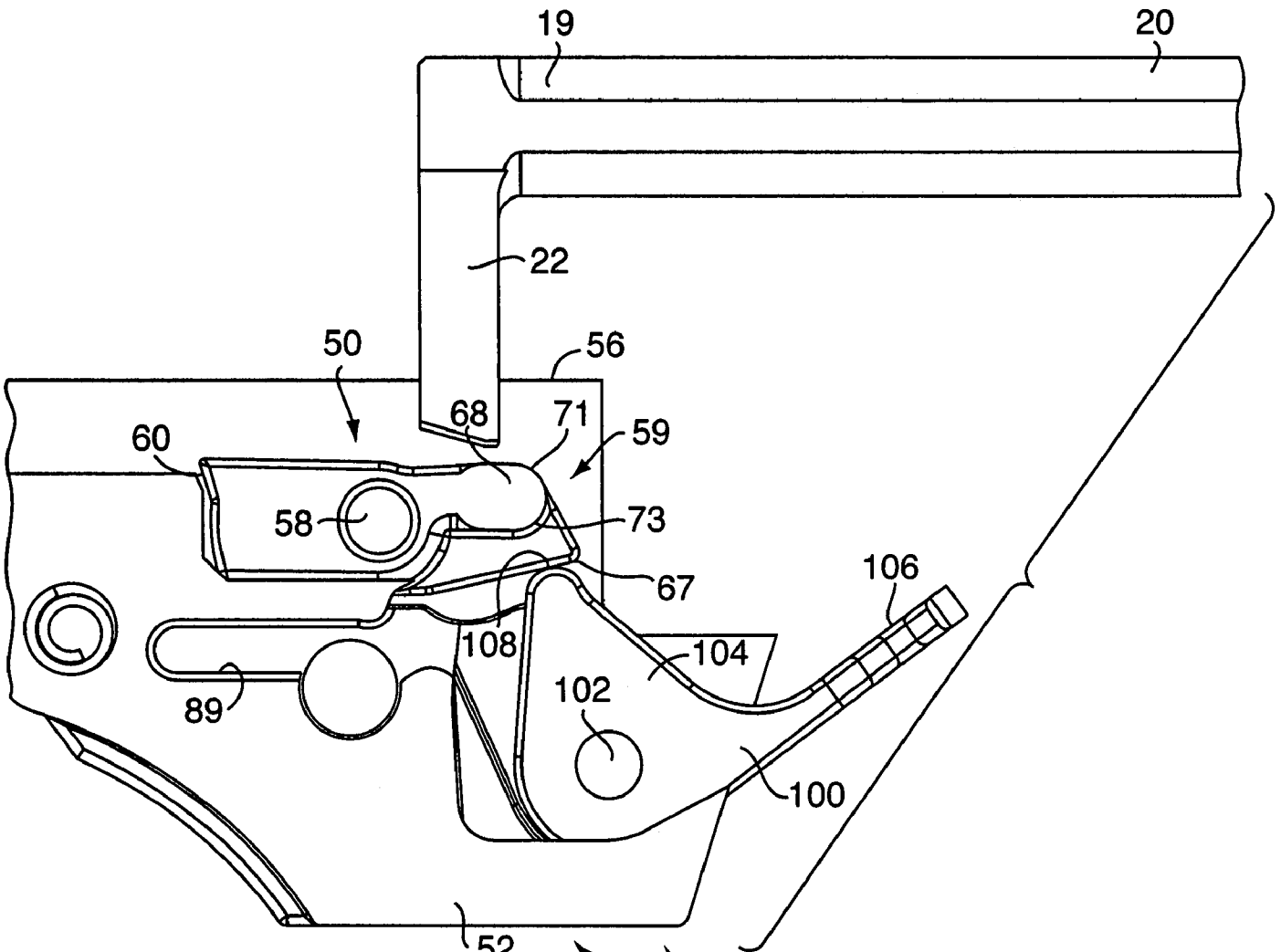

Referring now to FIGS. 8 and 9, the fire control mechanism 18 further includes a magazine detection lever 90 that operates in conjunction with the trigger bar 30. The magazine detection lever 90 is positioned adjacent the trigger bar 30 and is rotatable about a pivot pin that extends laterally through the frame of the handgun. A plane in which the magazine detection lever 90 rotates may be either coincidental or parallel to the plane in which the sear rotates. The magazine detection lever 90 includes a body portion 92, an arm 94 that extends away from the body portion 92 in the direction of the magazine well, and a ramped or camming surface 96 (FIG. 8) at the body portion 92 so as to be engagable with the trigger bar 30 when the arm 94 extends into the magazine well. A torsion spring 97 provides a rotational force to the magazine detection lever 90 to urge the arm 94 into the magazine well.

Upon insertion of a magazine into the magazine well, the lip of the magazine slides along the front surface of the arm 94 of the magazine detection lever 90 and causes the magazine detection lever 90 to rotate about the pivot pin. The arm 94 is urged in the direction of an arrow F, and the body portion is rotated about the pivot pin. This rotation then disengages the camming surface 96 of the magazine detection lever 90 from the trigger bar 30 and allows the trigger bar 30 to be urged back in towards the center of the handgun and into registration with the ramp of the sear 50. Upon removal of the magazine from the magazine well, the arm 94 is rotated in the direction of an arrow G under the bias of the torsion spring, as is shown in FIG. 9, and the body portion 92 rotates such that the camming surface 96 engages the trigger bar 30 and displaces it in the direction of an arrow H, thereby causing the trigger bar 30 to come out of registration with the ramp of the sear 50. Should the magazine not be fully engaged with the handgun, the trigger bar 30 will also be laterally displaced so as to cause the trigger bar 30 to come out of registration with the sear 50.

Referring now to FIGS. 3, 4, and 10-13, the fire control mechanism 18 further includes a sear deactivation lever 100 that operates in conjunction with the sear 50. The sear deactivation lever 100 is positioned adjacent the magazine detection lever 90 and is rotatable about a pivot pin 102 that extends laterally through the frame of the handgun. A plane in which the sear deactivation lever 100 rotates is parallel to the plane in which the magazine detection lever 90 rotates and at least partially coincidental to the plane in which the sear 50 rotates. At least a portion of the sear deactivation lever 100 registers with the ramp portion 67 of the sear 50 such that movement of the sear deactivation lever 100 effects the movement of the sear 50.

The sear deactivation lever 100 includes a body portion 104, an arm 106 that extends away from the body portion 104, and a sear contacting surface 108 at the body portion 104. The body portion 104 is mounted to be pivotable about the pivot pin 102. The sear contacting surface 108 may be machined, cast, or otherwise integrally formed with the body portion 104 at a rearward surface thereof. The arm 106 extends away from the body portion 104 and may be bent, twisted, or otherwise configured for engagement with a tool (not shown).

When the magazine is removed from the handgun, the firing chamber is empty, and the slide 14 is moved to its retired position and locked, the tool is inserted through the ejection port of the slide 14 and pressed against the arm 106 of the sear deactivation lever 100 to urge the arm 106 into the empty magazine well. Upon rotation of the sear deactivation lever 100, the sear contacting surface 108 engages the ramp portion 67 of the sear 50 and rotates the forward portion of the sear 50 upward while the rearward portion of the sear 50 is correspondingly rotated down. The slide 14 can then be closed (returned to its battery position). Because the rearward portion of the sear 50 is rotated down, the depending leg 22 of the firing pin 19 can clear the sear 50 (FIGS. 11 and 12) upon forward movement of the slide 14. Thus, because the manual pivoting of the sear deactivation lever 100 rotates the sear 50 to allow the firing pin 19 to move forward unobstructed, the fire control mechanism is deactivated without dry-firing the handgun. A lever, clip, or similar mechanism (not shown) can then be manipulated to allow the slide 14 to be removed from the frame.

Figure 13:
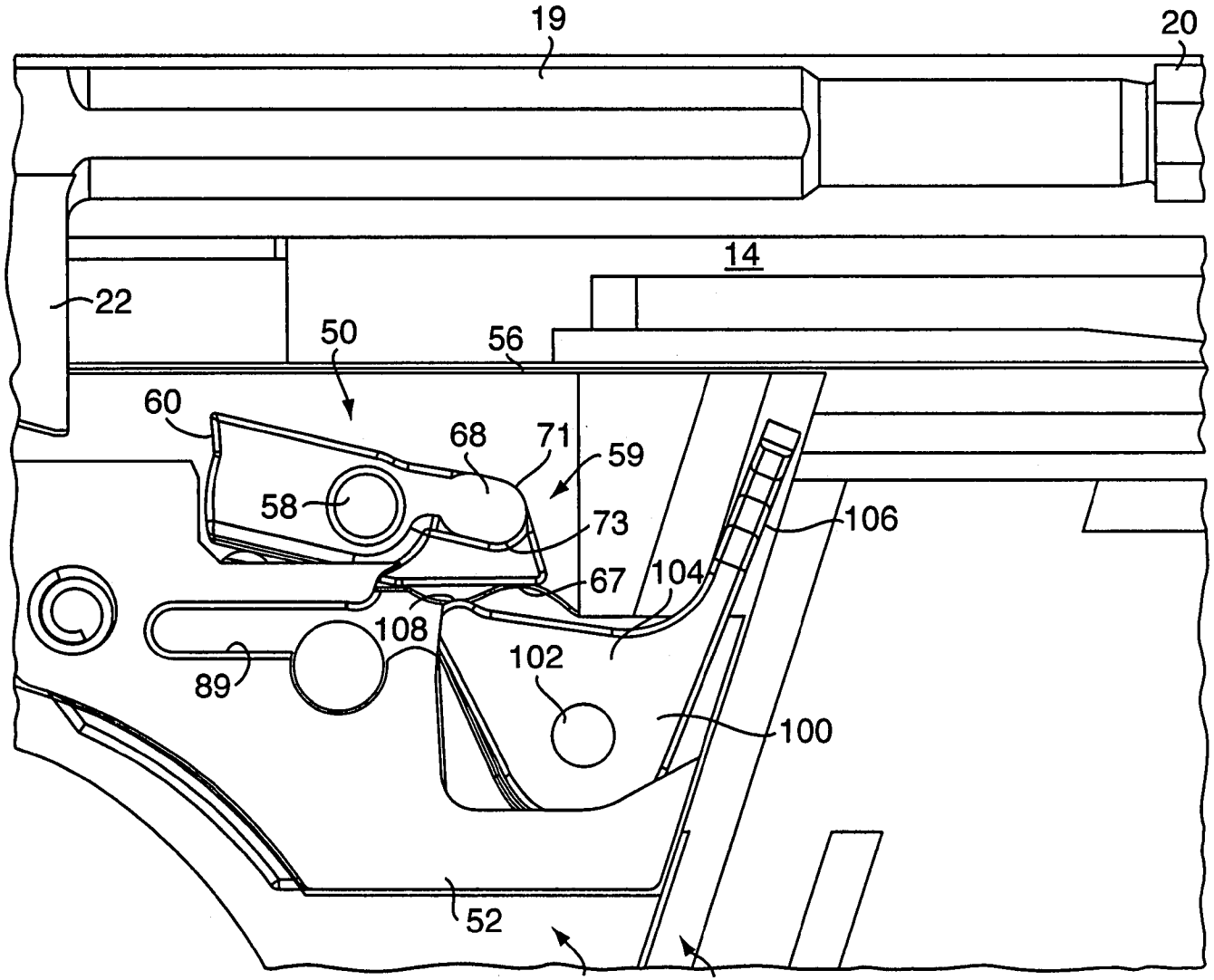

Referring now to FIG. 13, to replace the slide 14 on the frame, the rearward end of the slide 14 is brought into engagement with the rails on the forward end of the frame. The slide 14 is then slid in the rearward direction until it is fully seated on the frame. To return the sear deactivation lever 100 back to its active position in preparation for firing the handgun, a magazine is inserted into the magazine well. Upon such insertion, the arm 106 of the sear deactivation lever 100 is rotated upward, the forward end of the sear 50 is allowed to pivot downward, and the rear portion of the sear 50 is correspondingly allowed to pivot upward. Racking the slide 14 then allows the depending leg 22 of the firing pin 19 to engage the rearward surface 60 of the sear 50, thus cocking the handgun.

An embodiment of the present invention as described above is a fire control mechanism for a semiautomatic handgun. The handgun has a frame, a slide reciprocally mounted on the frame, a barrel, a firing pin, and a trigger. In this embodiment, the fire control mechanism may include a sear assembly in which a sear is mounted in a sear block housing, the sear being operably mounted so as to be pivotal about a fulcrum located substantially at the center of mass of the sear. The sear is pivotally movable about the fulcrum in response to the rearward longitudinal movement of a trigger bar.

In another embodiment of the present invention as described above, the handgun may include a fire control mechanism having a magazine detection lever that is operably engagable with a trigger bar of the fire control mechanism. A spring provides a rotational force to the magazine detection lever to urge an arm into a magazine well of the handgun into which a magazine can be received. A camming surface on a body of the magazine detection lever preferably engages the trigger bar and biases the trigger bar away from the sear.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A firearm comprising:

a frame, and a trigger connected to the frame;

a trigger bar having a receiving surface, the trigger bar connected to the trigger for rearwards movement when the trigger is actuated;

a firing pin operably disposed in a breech block located on the frame;

a sear pivotally connected to the frame about a fulcrum and having forward and rearward portions on opposite sides of the fulcrum, said forward portion being configured for engagement with the trigger bar and said rearward portion being configured for engagement with the firing pin;

a sear biasing member operably disposed in the frame for biasing the sear in a first pivotal direction for engaging the firing pin; and a slide operably connected to the frame and having a camming surface on an undersurface thereof;

wherein the camming surface engages the receiving surface on the trigger bar upon a movement of the slide in a rearwards direction; and wherein the movement of the slide in a rearwards direction causes the camming surface to exert a lateral force on the trigger bar to bias the trigger bar laterally out of registration with the sear.

2. The firearm of claim 1 wherein the trigger bar is configured to pivot the sear in a second pivotal direction against the action of the sear biasing member, when the trigger bar is moved in a rearwards direction, for selective disengagement of the rearward sear portion from the firing pin, whereby said firing pin thereafter moves forward for discharge of the firearm.

3. The firearm of claim 2 wherein the sear fulcrum is located substantially at a center of mass of the sear.

4. The firearm of claim 2 wherein:

the sear comprises an elongated member having a major axis, said fulcrum lying substantially perpendicular to the major axis;

the forward sear portion includes a cam having a rounded surface; and a rear portion of the trigger bar includes a sloped surface configured to engage the rounded surface of the cam for pivoting the sear in the second pivotal direction when the trigger bar is moved rearwards.

5. The firearm of claim 2 wherein:

the firearm further comprises a slide operably disposed on the frame and having a cam surface on an underside thereof; and the trigger bar includes a receiving surface, wherein the cam surface of the slide is configured to engage the trigger bar receiving surface for disengaging the trigger bar from the sear when the slide moves to a rearward position, said trigger bar reengaging the sear when the slide moves to a forward position.

6. The firearm of claim 2 further comprising:

a sear deactivation lever pivotally connected to the frame and configured for selectively rotating the sear in the second pivotal direction upon manual actuation of the sear deactivation lever.

7. The firearm of claim 6 wherein:

the forward portion of the sear includes a substantially flat ramp portion; and the sear deactivation lever comprises a body portion having a sear contacting surface, and an arm connected to the body portion for manual pivoting of the sear deactivation lever, wherein the sear contacting surface is configured for engaging the ramp portion of the sear for rotating the sear in the second pivotal direction upon manual actuation of the sear deactivation lever arm.

8. The firearm of claim 2 further comprising:

a magazine detection lever operably connected to the frame and configured for disengaging the trigger bar from the sear when a magazine well portion of the frame is without a magazine fully inserted therein.

9. The firearm of claim 8 wherein:

the magazine detection lever is pivotal between first and second positions, said lever having an arm portion extending into the magazine well, wherein in the first position the lever disengages the trigger bar from the sear and in the second position the lever allows the trigger bar to engage the sear, said lever pivoting from the first position to the second position upon insertion of a magazine into the magazine well a sufficient distance to fully depress the arm portion; and the firearm further comprises a lever biasing member operably connected to the lever for biasing the lever towards the first position for disengagement of the trigger bar from the sear when the magazine well is without a magazine fully inserted therein.

10. A firearm comprising:

a frame, and a firing pin operably disposed in a breech block located on the frame;

a sear pivotally connected to the frame about a fulcrum and having forward and rearward portions on opposite sides of the fulcrum, wherein the rearward portion is configured for selectively engaging the firing pin;

a trigger bar having a receiving surface, the trigger bar engaging the forward portion of the sear and configured for actuating the sear to release the firing pin when the trigger bar is moved rearwards; and a slide operably connected to the frame and having a camming surface on an undersurface thereof;

wherein the camming surface engages the receiving surface on the trigger bar upon a movement of the slide in a rearwards direction; and wherein the movement of the slide in a rearwards direction causes the camming surface to exert a lateral force on the trigger bar to bias the trigger bar laterally out of registration with the sear.

11. The firearm of claim 10 wherein:

the forward portion of the sear has a rounded camming surface which extends perpendicular to a direction of a major axis of the sear and parallel to a pivot axis of the sear defined by the fulcrum; and the trigger bar is configured to engage the camming surface for actuating the sear.

12. The firearm of claim 10 wherein the sear fulcrum is located substantially at a center of mass of the sear.

13. The firearm of claim 10 further comprising:

a magazine detection lever housed in the frame for disengaging the trigger bar from the sear unless a magazine is fully inserted into a magazine well portion of the frame.

14. The firearm of claim 10 further comprising:

a slide moveable along the frame from forward to rearward positions, wherein the slide is configured for disengaging the trigger bar from the sear upon movement of the slide from the forward to the rearward positions.

15. The firearm of claim 10 further comprising:

a sear deactivation lever pivotally connected to the frame proximate the sear for controllably disengaging the sear from the firing pin upon manual actuation of the sear deactivation lever.

16. A firearm comprising:

a frame, and a trigger bar having a receiving surface, the trigger bar being operably disposed in the frame;

a firing pin;

a sear operably mounted in the frame for controllably releasing the firing pin upon actuation of the trigger bar; and a slide operably connected to the frame and having a camming surface on an undersurface thereof;

wherein the camming surface engages the receiving surface on the trigger bar upon a movement of the slide in a rearwards direction; and wherein the movement of the slide in a rearwards direction causes the camming surface to exert a lateral force on the trigger bar to bias the trigger bar laterally out of registration with the sear.

17. A firearm comprising:

a frame with a magazine well; a firing mechanism operably housed in the frame and having a sear and a trigger bar engagable with the sear;

a magazine detection lever operably engagable with the trigger bar; and a biasing member acting upon the magazine detection lever to urge an arm portion thereof into the magazine well, wherein the magazine detection lever biases the trigger bar into disengagement from the sear unless a magazine is fully inserted into magazine well against the arm portion of the lever, wherein the magazine detection lever biases the trigger bar into lateral disengagement from the sear.

18. A firearm comprising:

a frame, and a trigger connected to the frame;

a trigger bar connected to the trigger for rearwards movement when the trigger is actuated;

a firing pin operably disposed in a breech block located on the frame;

a sear pivotally connected to the frame about a fulcrum and having forward and rearward portions on opposite sides of the fulcrum, said forward portion being configured for engagement with the trigger bar and said rearward portion being configured for engagement with the firing pin; and a sear biasing member operably disposed in the frame for biasing the sear in a first pivotal direction for engaging the firing pin;

wherein the trigger bar is configured to pivot the sear in a second pivotal direction against the action of the sear biasing member, when the trigger bar is moved in a rearwards direction, for selective disengagement of the rearward sear portion from the firing pin, whereby said firing pin thereafter moves forward for discharge of the firearm; and wherein the sear fulcrum is located substantially at a center of mass of the sear.

19. A firearm comprising:

a frame, and a trigger connected to the frame;

a trigger bar connected to the trigger for rearwards movement when the trigger is actuated;

a firing pin operably disposed in a breech block located on the frame;

a sear pivotally connected to the frame about a fulcrum and having forward and rearward portions on opposite sides of the fulcrum, said forward portion being configured for engagement with the trigger bar and said rearward portion being configured for engagement with the firing pin;

a sear biasing member operably disposed in the frame for biasing the sear in a first pivotal direction for engaging the firing pin; and a magazine detection lever operably connected to the frame and configured for disengaging the trigger bar from the sear when a magazine well portion of the frame is without a magazine fully inserted therein;

wherein the trigger bar is configured to pivot the sear in a second pivotal direction against the action of the sear biasing member, when the trigger bar is moved in a rearwards direction, for selective disengagement of the rearward sear portion from the firing pin, whereby said firing pin thereafter moves forward for discharge of the firearm.

20. The firearm of claim 19 wherein:

the magazine detection lever is pivotal between first and second positions, said lever having an arm portion extending into the magazine well, wherein in the first position the lever disengages the trigger bar from the sear and in the second position the lever allows the trigger bar to engage the sear, said lever pivoting from the first position to the second position upon insertion of a magazine into the magazine well a sufficient distance to fully depress the arm portion; and the firearm further comprises a lever biasing member operably connected to the lever for biasing the lever towards the first position for disengagement of the trigger bar from the sear when the magazine well is without a magazine fully inserted therein.

* * * * *